US005328526A

United States Patent [19]

Jo et al.

[11] Patent Number: 5,328,526

[45] Date of Patent: Jul. 12, 1994

[54] METHOD FOR ZINC-PHOSPHATING METAL SURFACE

[75] Inventors: Masahiro Jo, Osaka; Yasutake Mino, Hyogo; Tamotsu Sobata, Osaka, all of Japan

[73] Assignee: Nippon Paint Co., Ltd., Osaka, Japan

[21] Appl. No.: 40,964

[22] Filed: Mar. 31, 1993

[30] Foreign Application Priority Data

Apr. 3, 1992 [JP] Japan ..... 4-082507
Feb. 23, 1993 [JP] Japan ..... 5-033773

[51] Int. Cl.[5] ..... C23C 22/12
[52] U.S. Cl. ..... 148/260; 148/262; 148/263
[58] Field of Search ..... 148/261, 262

[56] References Cited

U.S. PATENT DOCUMENTS 3,969,152 7/1976 Melotik ..... 148/260
5,104,577 4/1992 Ikeda ..... 148/247

FOREIGN PATENT DOCUMENTS 42-17632 9/1967 Japan .
57-152472 9/1982 Japan .
61-36588 2/1986 Japan .

*Primary Examiner*—Sam Silverberg
*Attorney, Agent, or Firm*—Lowe, Price, LeBlanc & Becker

[57] ABSTRACT

A zinc phosphate coating film suitable for cationic electrodeposition coating and superior in both of coating film adhesion and corrosion resistance (especially, warm brine resistance and scab resistance) is formed by a conversion treatment of a metal surface using an acidic zinc-phosphating solution which does not contain a nickel ion as an essential component. The conversion treatment is carried out by bringing a metal surface into contact with a zinc-phosphating solution containing a zinc ion of 0.1 to 2.0 g/l, a phosphate ion of 5 to 40 g/l, a lanthanum compound of 0.001 to 3 g/l in terms of a lanthanum metal, and a phosphating accelerator, thereby the zinc phosphate coating film is formed on the metal surface.

8 Claims, No Drawings

METHOD FOR ZINC-PHOSPHATING METAL SURFACE

BACKGROUND OF THE INVENTION

The present invention relates to a treating method for forming a zinc phosphate coating film on a metal surface. In detail, the invention relates to a treating method for forming a zinc phosphate coating film, which is suitable for electrodeposition coating, especially for cationic electrodeposition coating and which is superior in coating film adhesion and corrosion resistance, especially, warm brine resistance and a property to prevent rust of a scab type (scab corrosion) (hereinafter, this property is referred to a "scab resistance"), on a metal surface having only one kind selected from the group consisting of an iron-based, a zinc-based and an aluminum-based surface or simultaneously having these surfaces in combination of two or more kinds by conversion treatment using an acidic zinc-phosphating solution.

Metal materials have been used in various fields such as automobile bodies and other attachments, building materials, furniture, and the like. Metal easily corrodes owing to oxygen or sulfur oxides in the air; rainwater; seawater; and so forth. Because of this, metal is treated with zinc phosphate as coating pretreatment to prevent corrosion. A zinc phosphate coating film formed by this treatment is required to be superior in adhesion to a metal surface which is a substratum, and also, to be superior in adhesion (secondary adhesion) to a coating film further formed on the zinc phosphate coating film and also, the zinc phosphate coating film is required to have sufficient rust preventability even if it is under corrosive environment. In particular, for an automobile body, the scab resistance, a high order of warm brine resistance and so forth are desired since a metallic material of a base is repeatedly subjected to penetration of salt water or variation of dry and wet atmospheric conditions from a scar of the external plate part.

Recently, there has been increased a case of zinc-phosphating a metallic material having two or more kinds of metal surfaces. For example, to elevate further the corrosion resistance of after-coating in a case of the automobile body, a material plated by zinc or a zinc alloy on a surface of a steel material is used. If a conventional zinc-phosphating treatment is carried out on such a metal surface simultaneously having both of an iron-based surface and a zinc-based surface, the zinc-based surface is inferior in corrosion resistance and secondary adhesion (adhesion after aging test) compared with the iron-based surface.

A zinc phosphate coating film formed on a metal surface does not comprise only zinc phosphate but contains various kinds of metal components besides zinc in order to elevate corrosion resistance. Especially, to obtain a zinc phosphate coating film superior in scab resistance and warm brine resistance, the zinc phosphate coating film has contained nickel as an essential component.

On the other hand, there has been proposed a method for forming a zinc phosphate coating film suitable for cationic electrodeposition coating on a surface of a metal material simultaneously having both of an iron-based and a zinc-based surface by zinc-phosphating the metal material using an acidic zinc-phosphating solution which does not contain nickel as an essential component. In the zinc-phosphating method described in Japanese Official Patent Provisional Publication No. showa 57-152472, an acidic zinc-phosphating solution containing 0.5 to 1.5 g/l of a zinc ion, 5 to 30 g/l of a phosphate ion, 0.6 to 3 g/l of a manganese ion, and a phosphating accelerator as main components is used. In the zinc-phosphating method described in Japanese Official Patent Gazette No. showa 61-36588, an acidic zinc-phosphating solution containing 0.5 to 1.5 g/l of a zinc ion, 5 to 30 g/l of a phosphate ion, 0.6 to 3 g/l of a manganese ion, 0.05 g/l or more of a fluorine ion, and a phosphating accelerator as main components is used in order to form a further superior coating film on a metal surface simultaneously having both of an iron-based and a zinc-based surface and to lower a treating temperature. If necessary, the two kinds of phosphating solutions cited here contains 0.1 to 4 g/l of a nickel ion to elevate further the secondary adhesion and corrosion resistance compared with the case of using a manganese ion alone.

In recent years, environmental regulation has tended to become strict, an amount for use of nickel necessary for forming a zinc phosphate coating film superior in scab resistance and warm brine resistance has begun to be limited, and there is probability that use of nickel will become completely impossible in the future.

In case that the phosphating solutions described in the above-mentioned two publications contain nickel, they make a substratum for cationic electrodeposition coating which is good in the secondary adhesion and superior in the scab resistance and warm brine resistance. However, in case that the solutions do not contain nickel, they make a substratum which is good in the secondary adhesion but inferior in the scab resistance or warm brine resistance. Therefore, for making a zinc phosphate coating film superior in corrosion resistance, use of a phosphating solution containing nickel cannot be helped.

SUMMARY OF THE INVENTION

It is an object of the present invention to provide a zinc-phosphating method for forming a zinc phosphate coating film suitable for electrodeposition coating, especially cationic electrodeposition coating, and superior in both of coating film adhesion and corrosion resistance (especially, warm brine resistance and scab resistance) by conversion treatment of a metal surface using an acidic zinc-phosphating solution which does not contain nickel as an essential component.

A material made by plating a surface of a steel sheet with zinc or a zinc alloy, or a material made by combining an aluminum material with at least one of an iron material and a zinc-plated iron material has been practically used in various fields such as automobiles, building materials and so forth. It is desired to form a coating film having superior adhesion and high corrosion resistance on surfaces of the above-mentioned metallic materials by conversion treatment of the surfaces with the same zinc-phosphating solution.

It is another object of the present invention to provide a zinc-phosphating method for forming a zinc phosphate coating film suitable for electrodeposition coating, especially cationic electrodeposition coating, and superior in both of coating film adhesion and corrosion resistance (especially, warm brine resistance and scab resistance) by conversion treatment of a metal surface having only one kind selected from the group consisting of an iron-based, a zinc-based and an aluminum-based surface or simultaneously having these surfaces in combination of two or more kinds using the same acidic zinc-phosphating solution which does not contain nickel as an essential component.

To solve the object, a method for zinc-phosphating a metal surface, relating to the present invention, comprises forming a zinc phosphate coating film on a metal surface by bringing the metal surface into contact with an acidic zinc-phosphating solution containing a zinc ion in a concentration of 0.1 to 2.0 g/l, a phosphate ion in a concentration of 5 to 40 g/l, a lanthanum compound in a concentration of 0.001 to 3 g/l in terms of a lanthanum metal, and a phosphating accelerator (a).

Although a metal surface to be treated by the method of the present invention is not specially limited, examples of the metal surface are a sole metal surface selected from an iron-based surface, a zinc-based surface and an aluminum-based surface, or a metal surface having jointly two or more kinds of these surfaces.

An acidic zinc-phosphating solution used in the present invention (hereinafter, the "zinc-phosphating solution" means "acidic zinc-phosphating solution" unless otherwise stated) needs to contain three components of a zinc ion, a phosphate ion and a lanthanum compound as essential components.

Each component contained in a zinc-phosphating solution used in the present invention is expressed as an ion if it usually exists in an ionic form, and also, the component is expressed as a compound if it usually exists in a compound form. However, there is a case that even a component expressed as an ion partially exists in a nonionic form, that is, in a compound form. Also, there is a case that even a component expressed as a compound partially exists in a non-compound form, that is, in an ionic form. A content of each component in the present invention is shown in proportion which includes the nonion or non-compound as well.

The concentration of a lanthanum compound in the phosphating solution is necessarily 0.001 to 3 g/l in terms of a lanthanum metal, and preferably 0.01 to 2 g/l. If the concentration is less than 0.001 g/l in terms of a lanthanum metal, improvement of a zinc phosphate coating film is insufficient and, scab resistance and warm brine resistance are not elevated. On the other hand, if the concentration is more than 3 g/l in terms of a lanthanum metal, a zinc phosphate coating film is not uniformly formed on an iron-based surface and a part of the zinc phosphate coating film forms yellow rust, so that the corrosion resistance after coating lowers.

The concentration of zinc ions is preferably 0.1 to 2.0 g/l, more preferably 0.3 to 1.5 g/l. If the concentration is less than 0.1 g/l, a zinc phosphate coating film is not uniformly formed on a metal surface, lack of hiding is much found, and a coating film of partly blue color type is occasionally formed. Also, if the concentration exceeds 2.0 g/l, although a uniform zinc phosphate coating film is formed, a coating film liable to be soluble in an alkali is easily formed, and there is a case where the coating film becomes easy soluble under an alkaline atmosphere to which it is exposed especially in the course of cationic electrodeposition process. As a result, the warm brine resistance generally diminishes and, especially in a case of an iron-based surface, scab resistance deteriorates and, thus, because desired capability is not obtained, the coating film is not suitable as a coating substratum for electrodeposition coating, especially, cationic electrodeposition coating.

In the zinc-phosphating solution, a weight ratio of the zinc ion to the lanthanum metal is preferably in a range from 1:0.01 to 1:1.5. If an amount of the lanthanum metal is smaller than the above range, improvement of a zinc phosphate coating film may be insufficient and, scab resistance and warm brine resistance may be not elevated. On the other hand, if the amount of the lanthanum metal is larger than the above range, a zinc phosphate coating film may be not uniformly formed on an iron-based surface and a part of the zinc phosphate coating film may form yellow rust, so that the corrosion resistance after coating may lower.

The concentration of phosphate ions is preferably 5 to 40 g/l, more preferably 10 to 30 g/l. If the concentration is less than 5 g/l, a ununiform coating film is easy to form and, if the concentration exceeds 40 g/l, elevation of the effects corresponding to increase of the concentration cannot be expected and it is economically disadvantageous because an amount for use of chemicals becomes large.

A zinc-phosphating solution used in the present invention preferably contains a phosphating accelerator (a) in a case where the whole or a part of a metal surface to be treated is an iron-based surface. The phosphating accelerator (a) is preferably at least one kind selected from the group consisting of a nitrite ion, a m-nitrobenzenesulfonate ion, and hydrogen peroxide. A preferable concentration of them is, for example, as follows (a more preferable concentration is shown in parentheses):

for the nitrite ion, 0.01 to 0.5 (0.01 to 0.4) g/l;

for the m-nitrobenzenesulfonate ion, 0.05 to 5 (0.1 to 4) g/l;

for the hydrogen peroxide, 0.5 to 10 g/l in terms of 100% $H_2O_2$.

If a concentration of the phosphating accelerator (a) is less than the above-described range, sufficient coating film-conversion does not occur on an iron-based surface and yellow rust is easy to generate and also, if the concentration exceeds the above-described range, a ununiform coating film of a blue color type is easy to form on the iron-based surface.

A zinc-phosphating solution used in the present invention preferably contains a manganese ion in a case where the whole or a part of a metal surface to be treated is a zinc-based surface. A concentration of the manganese ion is preferably 0.1 to 3 g/l, more preferably 0.6 to 3 g/l. If the concentration is less than 0.1 g/l, the adhesion between a zinc-based surface and a coating film after electrodeposition coating as well as an elevating effect on the warm brine resistance becomes insufficient. If the concentration exceeds 3 g/l, effects corresponding to increase of the amount cannot be expected, which is economically disadvantageous.

If necessary, a zinc-phosphating solution used in the present invention may contain a fluorine compound in order to attain fining of zinc phosphate coating film crystals, elevation of corrosion resistance, and treatment with zinc phosphate at a low temperature. The fluorine compound is preferably at least one kind selected from the group consisting of a water-soluble simple fluoride and a water-soluble complex fluoride. A concentration of the fluorine compound is preferably 0.05 g/l or more, more preferably 0.1 to 2 g/l, as the total concentration of a simple fluoride in terms of HF and a complex fluoride ion. If the concentration of the fluorine compound is less than 0.05 g/l, the fining of a zinc phosphate coating film crystals, elevation of corrosion resistance, and treatment with zinc phosphate at a low temperature cannot be attained. If the concentration exceeds 2 g/l, increase of an adding amount does not result in elevation of effects, which is economically disadvantageous.

A zinc-phosphating solution used in the present invention preferably contains a simple fluoride in a concentration of 0.01 to 0.5 g/l in terms of HF and the complex fluoride ion in a concentration of 0.05 g/l or more in a case where the whole or a part of a metal surface to be treated is an aluminum-based surface. If the simple fluoride concentration is less than 0.01 g/l in terms of HF, since aluminum ions being dissolved form a water-soluble complex fluoride, an aluminum content in the phosphating solution increases and, in addition to this, it is feared that conversion inferiority occurs. If the simple fluoride concentration exceeds 0.5 g/l, $Na_3AlF_6$ mingles in a zinc phosphate coating film on the aluminum-based surface and warm brine resistance after cationic electrodeposition coating lowers. If the concentration of the complex fluoride ion is less than 0.05 g/l, it is feared that the fining of phosphate coating film crystals and elevation of corrosion resistance are not attained.

The simple fluoride concentration in terms of HF is determined using a commercially-available silicon electrode meter or fluorine ion meter. An active fluorine concentration is measured as HF by the silicon electrode meter. The silicon electrode meter has high sensitivity in a pH range (acidic region) of a zinc-phosphating solution used in the present invention and has an advantage that an indicated value becomes large in proportion to the active fluorine concentration. An example of the silicon electrode meter is the one shown in Japanese Official Patent Gazette No. showa 42-17632, but the meter is not limited to this example. The silicon electrode meter is commercially provided with the trade name of Surfproguard 101N from Nippon Paint Co., Ltd. and, besides this, many silicon electrode meters are on the market and easily available. The silicon electrode meter is generally arranged so that an electric current value can be read by bringing a p-type silicon electrode and an inactive electrode made of platinum into contact with a measured solution, under the condition where the solution is not in light, and connecting both of these electrodes with a direct current source. The active fluorine concentration can be measured by giving a direct current voltage between both of the electrodes, under the conditions where the measured solution is allowed to be in a static state or to make a flow steadily, and then by reading an electric current value when this value has become stationary.

The complex fluoride ion concentration is calculated by measuring each element of silicon and boron by atomic absorption spectrometry or induction bond plasma emission analysis.

Examples of the above-mentioned simple fluoride are HF, NaF, KF, $NH_4F$, $NaHF_2$, $KHF_2$ and $NH_4HF_2$. Examples of the above-mentioned complex fluoride ion are $SiF_6^{2-}$ and $BF_4^-$.

A zinc-phosphating solution used in the present invention preferably contains at least one kind selected from the group consisting of a cobalt ion, a magnesium ion, a calcium ion and a copper ion in the undermentioned specific concentration ranges in order to elevate further the corrosion resistance and so forth of a zinc phosphate coating film.

A concentration range of the cobalt ion is preferably 0.1 to 4 g/l, more preferably 0.3 to 3 g/l. If the concentration is less than 0.1 g/l, the effect of elevating corrosion resistance becomes insufficient and, if the concentration exceeds 4 g/l, the effect of elevating corrosion resistance tends to diminish.

A concentration range of the magnesium ion is preferably 0.1 to 3 g/l, more preferably 0.1 to 2.5 g/l. If the concentration is less than 0.01 g/l, the effect of elevating corrosion resistance becomes insufficient and, if the concentration exceeds 3 g/l, the effect of elevating corrosion resistance tends to diminish.

A concentration range of the calcium ion is preferably 0.01 to 3 g/l, more preferably 0.1 to 2.5 g/l. If the concentration is less than 0.01 g/l, the effect of elevating corrosion resistance becomes insufficient and, if the concentration exceeds 3 g/l, the effect of elevating corrosion resistance tends to diminish.

A concentration range of the copper ion is preferably 0.005 to 0.2 g/l, more preferably 0.01 to 0.1 g/l. If the concentration is less than 0.005 g/l, the effect of elevating corrosion resistance becomes insufficient and, if the concentration exceeds 0.2 g/l, although the scab resistance is elevated, the effect of elevating warm brine resistance tends to diminish.

A zinc-phosphating solution used in the present invention may contain a phosphating accelerator (b) in order to further elevate the conversion of an iron-based surface, if necessary. This phosphating accelerator (b) is preferably at least one kind selected from the group consisting of a nitrate ion and a chlorate ion. A concentration range of the nitrate ion is preferably 0.1 to 15 g/l, more preferably 2 to 10 g/l. A concentration range of the chlorate ion is preferably 0.05 to 2.0 g/l, more preferably 0.2 to 1.5 g/l. The phosphating accelerator (b) may be used jointly with the phosphating accelerator (a), or the (b) may be used alone without the (a).

A supplying source of each of the forementioned components in a zinc-phosphating solution is not specially limited, but examples of the supplying source for use are as follows:

Lanthanum compound:

Lanthanum compounds such as lanthanum nitrate, lanthanum sulfate, lanthanum carbonate, lanthanum fluoride, lanthanum chloride, lanthanum oxalate, lanthanum acetate and the like.

Zinc ion:

Zinc compounds such as zinc oxide, zinc carbonate, zinc nitrate and the like.

Phosphate ion:

Phosphoric acid; phosphates such as zinc phosphate, manganese phosphate, cobalt phosphate and the like; and others.

Phosphating accelerator (a):

Nitrous acid; nitrites such as sodium nitrite, ammonium nitrite and the like; m-nitrobenzenesulfonates such as sodium m-nitrobenzenesulfonate and the like; hydrogen peroxide; and others.

Phosphating accelerator (b):

Chlorates such as sodium chlorate, ammonium chlorate, and the like; nitric acid; nitrates such as sodium nitrate, ammonium nitrate, zinc nitrate, manganese nitrate, cobalt nitrate, calcium nitrate, magnesium nitrate, nickel nitrate, copper nitrate and the like; and others.

Manganese ion:

Manganese compounds such as manganese carbonate, manganese nitrate, manganese chloride, manganese phosphate, manganese sulfate and the like.

Cobalt ion:

Cobalt compounds such as cobalt nitrate, cobalt sulfate, cobalt phosphate, cobalt hydroxide, cobalt chloride, cobalt fluoride and the like.

Magnesium ion:

Magnesium compounds such as magnesium nitrate, magnesium sulfate, magnesium phosphate, magnesium fluoride, magnesium hydroxide, magnesium carbonate and the like.

Calcium ion:

Calcium compounds such as calcium nitrate, calcium sulfate, calcium phosphate, calcium fluoride, calcium carbonate, calcium hydroxide, calcium chloride and the like.

Copper ion:

Copper compounds such as copper nitrate, copper chloride, copper sulfate and the like.

Simple fluoride:

HF, NaF, KF, $NH_4F$, $NaHF_2$, $KHF_2$, $NH_4HF_2$ and the like.

Complex fluoride ion:

Borofluoric acid, hydrosilicofluoric acid, salts of these acids (for example, zinc salt, cobalt salt, nickel salt), and the like.

Although a zinc-phosphating solution used in the present invention forms on a metal surface a zinc phosphate coating film superior in adhesion and corrosion resistance even if the solution does not contain any nickel ion, it can contain a nickel ion in case of necessity.

When a zinc-phosphating method of the present invention is carried out, a temperature of the zinc-phosphating solution is preferably 20° to 70° C., more preferably 35° to 60° C. If the temperature is lower than 20° C., the coating film-conversion is bad, so that it takes a long time for treatment. Also, if the temperature is higher than 70° C., balancing of the solution is easily broken by decomposition of a phosphating accelerator and formation of a precipitate, so that an excellent coating film is hard to obtain.

A period of time for treatment with the zinc-phosphating solution is preferably 15 seconds or longer, more preferably 30 to 120 seconds. If the time is shorter than 15 seconds, there is a case where a coating film having desired crystals is not sufficiently formed. Furthermore, in a case where a metallic material having a complicate shape such as an automobile body is treated, it is practically preferable to combine an immersing treatment with a spraying treatment. In this case, for example, the material is at first subjected to the immersing treatment for 15 seconds or longer, preferably for 30 to 120 seconds, and then subjected to the spraying treatment for 2 seconds or longer, preferably for 5 to 45 seconds. Besides, to wash off sludge attached in the course of the immersing treatment, it is preferably to carry out the spraying treatment as long as possible. Accordingly, a zinc-phosphating method of the present invention includes the immersing treatment, the spraying treatment and a treating embodiment made by combining these treatments.

In the present invention, since a component contained in a zinc-phosphating solution is consumed by the conversion treatment, it is necessary continually to maintain composition of the solution by adding and supplying, on demand, the consumed component to the solution in a case of carrying out continuously the conversion treatment of many materials to be treated. Since not all the components contained in the solution are consumed in the same ratio, it is preferable to provide two or three kinds of concentrated solutions for supplement.

If the conversion treatment is carried out by bringing a metal surface into contact with an acidic zinc-phosphating solution containing a zinc ion in a concentration of 0.1 to 2.0 g/l, a phosphate ion in a concentration of 5 to 40 g/l, a lanthanum compound in a concentration of 0.001 to 3 g/l in terms of a lanthanum metal, and a phosphating accelerator (a), a zinc phosphate coating film is formed which is suitable for electrodeposition coating, especially for cationic electrodeposition coating and superior in both of coating film adhesion and corrosion resistance (especially, warm brine resistance and scab resistance).

According to a method relating to the present invention for zinc-phosphating a metal surface, it is possible to make the metal surface suitable for electrodeposition coating, especially for cationic electrodeposition coating and superior in both of coating film adhesion and corrosion resistance (especially, warm brine resistance and scab resistance). In addition, since a zinc-phosphating solution used for this method does not contain a nickel ion as an essential component, it is possible to diminish a nickel ion content compared with a conventional zinc-phosphating solution and it is also possible that the nickel ion content is zero.

DESCRIPTION OF THE PREFERRED EMBODIMENTS

Hereinafter, concrete examples and comparative examples of the present invention are shown, but the invention is not limited to the undermentioned examples.

At first, examples and comparative examples of a zinc-phosphating method in a case where a metal to be treated has only the iron-based metal surface are shown.

EXAMPLES 1 to 4 and COMPARATIVE EXAMPLES 1 and 2

(1) Metal to be treated:

A cold rolled steel sheet (iron-based metal surface) was used.

(2) Treating process:

A coated metal sheet was obtained by treating successively the cold rolled steel sheet according to the steps of: (a) degreasing, (b) rinsing, (c) surface-conditioning, (d) conversion (dip treatment), (e) rinsing, (f) rinsing with pure water, (g) drying and (h) coating; details of which were shown in the below-mentioned (3).

(3) Treating conditions:

(a) Degreasing:

Using an alkaline degreasing agent ("Surf Cleaner SD 250" made by Nippon Paint Co., Ltd.) in a concentration of 2% by weight, an immersing treatment was carried out at 40° C. for 2 minutes. Bath management in this treatment was carried out by maintaining alkalinity (a ml number of 0.1N-HCl required for neutralizing 10 ml of the bath using bromophenol blue as an indicator) at an initial value. The Surf Cleaner SD 250 was used as a supplementary chemical.

(b) Rinsing:

A spray cleaning treatment by water pressure was carried out using tap water.

(c) Surface-conditioning:

Using a Surface-conditioner ("Surf Fine 5N-5" made by Nippon Paint Co., Ltd.) in a concentration of 0.1% by weight, an immersing treatment was carried out at room temperature for 15 seconds. Bath management in this treatment was carried out by maintaining alkalinity by supplementing the Surf Fine 5N-5.

(d) Conversion (dip treatment):

Using a zinc-phosphating solution having composition shown in Table 1, a cold rolled steel sheet was subjected to an immersing treatment 40° C. for 2 minutes. Bath management in this treatment was carried out by measuring a $NO_2$ ion concentration and acidity of a free acid in the zinc-phosphating solution (the acidity was a ml number of 0.1N-NaOH required for neutralizing 10 ml of the bath using bromophenol blue as an indicator, with the proviso that, in a case where the treating bath contained cobalt, the acidity was a ml number of 0.1N-NaOH required till a pH value of the bath reached 3.6), by supplementing to the phosphating solution a concentrated solution for supplement comprising an aqueous solution containing sodium nitrite in a concentration of 20% by weight in accordance with decrease of the $NO_2$ ion concentration as well as a concentrated solution for supplement of other components in accordance with decrease of the acidity of a free acid, and by maintaining each of the acidity of a free acid and the $NO_2$ ion concentration at an initial value.

TABLE 1

| composition of zinc phosphating solution | EXAMPLE 1 | EXAMPLE 2 | EXAMPLE 3 | EXAMPLE 4 | COMPARATIVE EXAMPLE 1 | COMPARATIVE EXAMPLE 2 |
|---|---|---|---|---|---|---|
| Zn ion (g/l) | 1.0 | 1.0 | 1.0 | 1.0 | 1.0 | 1.0 |
| $PO_4$ ion (g/l) | 15.0 | 15.0 | 15.0 | 15.0 | 15.0 | 15.0 |
| $La(NO_3)_3$* (g/l) | 0.6 | 0.1 | 1.5 | 0.6 | — | — |
| Co ion (g/l) | — | 0.6 | — | — | — | — |
| Mg ion (g/l) | — | — | 1.0 | — | — | — |
| Cu ion (g/l) | — | — | — | 0.01 | — | — |
| Ni ion (g/l) | — | — | — | — | — | 1.0 |
| $NO_2$ ion (g/l) | 0.14 | 0.09 | 0.14 | 0.14 | 0.09 | 0.14 |
| $NO_3$ ion (g/l) | 6.0 | 6.0 | 6.0 | 6.0 | 6.0 | 6.0 |
| $ClO_3$ ion (g/l) | 1.0 | — | 0.5 | — | 1.0 | — |
| total acidity (point) | 17.9 | 17.3 | 21.3 | 18.0 | 17.6 | 18.7 |
| acidity of free acid (point) | 0.7 | 0.7 | 0.7 | 0.7 | 0.7 | 0.7 |

*weight (g/l) in terms of lanthanum metal.

(e) Rinsing:

Rinsing was carried out at room temperature for 15 seconds using tap water.

(f) Rinsing with pure water:

An immersing treatment was carried out at room temperature for 15 seconds using ion-exchange water.

(g) Drying:

Drying was carried out at 100° C. for 10 minutes.

(h) Coating:

Using a cationic electrodeposition coat "Power Top U-1000" made by Nippon Paint Co., Ltd., a cationic electrodeposition coating was carried out by a conventional method to form a cationic electrodeposition coating film having thickness of 30 μm. On this film, a melamine alkyd-based intermediate coat made by Nippon Paint Co., Ltd. was coated by a conventional method to form an intermediate coating film having thickness of 30 μm. On this film, a melamine alkyd-base top coat made by Nippon Paint Co., Ltd. was coated by a conventional method to form a top coating film having thickness of 40 μm.

For the coated metal sheets obtained in EXAMPLE 1 to 4 and COMPARATIVE EXAMPLES 1 and 2, coating film qualities were examined and evaluated by carrying out the below-mentioned tests. Results from these tests are shown in Table 2 described below.

Test for warm brine resistance:

On the electrodeposition coated sheets, cuts reaching the metal sheets which were the substrata were made by a keen cutter. Then the electrodeposition coated sheets were immersed in an aqueous 5% sodium chloride solution of 55° C. for 480 hours. After that, an adhesive tape was pasted on the cut parts and then peeled off, and a maximum peeled-off width (on both sides of the cut parts: unit of mm) was measured.

Test for water resistant secondary adhesion:

The three-coated sheets treated with electrodeposition coating, intermediate coating and top coating were immersed in ion-exchange water of 50° C. for 20 days. Then cuts of checkerboard squares (100 pieces) having 1 mm intervals were made on the three-coated sheets by a keen cutter in such a manner that the cut parts reached the metal sheets which were the substrata. On each face of the checkerboard squares, an adhesive tape was pasted and then peeled off, and it was counted how many cut square pieces of the coating film remained on the coated sheets.

Test for scab resistance:

On the three-coated sheets treated with electrodeposition coating, intermediate coating and top coating, cuts reaching the metal sheets which were the substrata were made by a keen cutter. Next, these coated sheets were subjected to the corrosion test of 200 cycles in which one cycle consisted of a 5%-brine spraying test (based on JIS-Z-2371 and for 2 minutes), drying (at 60° for 58 minutes), and a humidity test (95 % RH at 50° C. for 58 minutes), and a humidity test (95% RH at 50° C. for 3 hours) in this sequence. After the corrosion test, a maximum width (one side width from the cut parts in mm unit) of abnormality on the coating film (filament type rust, expansion and the like) on the coated surface was examined.

TABLE 2

| material | test item | EXAMPLE 1 | EXAMPLE 2 | EXAMPLE 3 | EXAMPLE 4 | COMPARATIVE EXAMPLE 1 | COMPARATIVE EXAMPLE 2 |
|---|---|---|---|---|---|---|---|
| cold rolled steel sheet | warm brine resistance (mm) | 1.5 | 0.5 | 1.0 | 1.5 | 8.5 | 2.0 |
| | scab resistance (mm) | 9.0 | 7.0 | 8.0 | 5.5 | 16.0 | 10.0 |

As seen in Tables 1 and 2, the warm brine resistance and scab resistance in EXAMPLES 1 to 4 were elevated, compared with those in COMPARATIVE EXAMPLE 1 in which a phosphating solution containing neither a nickel ion nor a lanthanum compound was used. Furthermore, the scab resistance in EXAMPLES 1 to 4 was elevated compared with that in COMPARATIVE EXAMPLE 2 in which a phosphating solution not containing a lanthanum compound but a nickel ion was used. Especially, the scab resistance in EXAMPLE 4 was remarkably elevated compared with that in EXAMPLES 1 to 3. This resulted from a multiplied effect of a lanthanum compound and a copper ion.

Next, examples and comparative examples of a zinc-phosphating method in a case where a metal to be treated has solely the iron-based metal surface, solely the zinc-based metal surface, or the combined metal surface of these metal surfaces are shown.

EXAMPLES 5 to 10 and COMPARATIVE EXAMPLES 3 and 4

The procedure of EXAMPLE 1 was repeated except for using two kinds consisting of a cold rolled steel sheet (an iron-based metal surface) and an alloyed melt zinc-plated steel sheet (a zinc-based metal surface) as a metal to be treated, using the zinc-phosphating solutions having composition shown in Table 3, and supplementing to the zinc-phosphating solutions a concentrated solution for supplement comprising an aqueous solution containing sodium nitrite in a concentration of 20% by weight in accordance with decrease of the $NO_2$ ion concentration as well as a concentrated solution for supplement of other components in accordance with decrease of the acidity of a free acid. Thereby coated metal sheets were obtained.

TABLE 3

| composition of zinc phosphating solution | EXAMPLE 5 | 6 | 7 | 8 | 9 | 10 | COMPARATIVE EXAMPLE 3 | 4 |
|---|---|---|---|---|---|---|---|---|
| Zn ion (g/l) | 1.0 | 1.0 | 1.0 | 1.0 | 1.0 | 1.0 | 1.0 | 1.0 |
| $PO_4$ ion (g/l) | 15.0 | 15.0 | 15.0 | 15.0 | 15.0 | 15.0 | 15.0 | 15.0 |
| $La(NO_3)_3$* (g/l) | 0.6 | 0.1 | 1.5 | 0.6 | 0.005 | 0.05 | — | — |
| Mn ion (g/l) | 1.0 | 0.6 | 0.6 | 0.6 | 0.6 | 0.6 | 0.6 | 0.6 |
| Co ion (g/l) | — | 0.6 | — | — | — | 0.1 | — | — |
| Mg ion (g/l) | — | — | 1.0 | — | — | — | — | — |
| Cu ion (g/l) | — | — | — | 0.01 | 0.01 | 0.01 | — | — |
| Ni ion (g/l) | — | — | — | — | — | — | — | 1.0 |
| $SiF_6$ ion (g/l) | — | 0.8 | 0.5 | 0.5 | 0.5 | 0.8 | 0.8 | 0.8 |
| $NO_2$ ion (g/l) | 0.14 | 0.09 | 0.14 | 0.14 | 0.14 | 0.14 | 0.09 | 0.09 |

TABLE 3-continued

| composition of zinc phosphating solution | EXAMPLE 5 | 6 | 7 | 8 | 9 | 10 | COMPARATIVE EXAMPLE 3 | 4 |
|---|---|---|---|---|---|---|---|---|
| $NO_3$ ion (g/l) | 6.0 | 6.0 | 6.0 | 6.0 | 6.0 | 6.0 | 6.0 | 6.0 |
| total acidity (point) | 19.2 | 19.6 | 22.6 | 19.3 | 19.0 | 19.5 | 18.8 | 18.9 |
| acidity of free acid (point) | 0.7 | 0.7 | 0.7 | 0.7 | 0.7 | 0.7 | 0.7 | 0.7 |

*weight (g/l) in terms of lanthanum metal.

For the coated metal sheets obtained in EXAMPLES 5 to 10 and COMPARATIVE EXAMPLES 3 and 4, coating film qualities were examined and evaluated by carrying out the forementioned tests. Their results are shown in Table 4.

TABLE 4

| material | test item | EXAMPLE 5 | 6 | 7 | 8 | 9 | 10 | COMPARATIVE EXAMPLE 3 | 4 |
|---|---|---|---|---|---|---|---|---|---|
| cold rolled steel sheet | warm brine resistance (mm) | 1.0 | 0.5 | 0.5 | 1.0 | 1.0 | 0.5 | 2.0 | 1.5 |
| | water resistant secondary adhesion | 100 | 100 | 100 | 100 | 100 | 100 | 100 | 100 |
| | scab resistance (mm) | 8.0 | 6.0 | 7.0 | 6.0 | 7.0 | 6.0 | 11.5 | 9.0 |
| alloyed melt zinc-plated steel sheet | warm brine resistance (mm) | 2.5 | 2.0 | 2.5 | 3.0 | 3.0 | 2.0 | 4.0 | 3.0 |
| | water resistant secondary adhesion | 100 | 100 | 100 | 100 | 100 | 100 | 100 | 100 |
| | scab resistance (mm) | 1.5 | 1.0 | 1.5 | 1.5 | 1.5 | 1.5 | 4.0 | 1.5 |

As seen in Tables 3 and 4, the warm brine resistance and scab resistance of both the iron-based metal surface and the zinc-based metal surface in EXAMPLES 5 to 10 were elevated compared with those in COMPARATIVE EXAMPLE 3 in while a phosphating solution containing neither a nickel ion nor a lanthanum compound was used. Furthermore, the warm brine resistance and scab resistance of the iron-based metal surface in EXAMPLES 5 to 10 were equal to or more than those in COMPARATIVE EXAMPLE 4 in which a phosphating solution not containing a lanthanum compound but a nickel ion was used.

Next, examples and comparative examples of a zinc-phosphating method in a case where a metal to be treated has solely the iron-based metal surface, solely the zinc-based metal surface, solely the aluminum-based metal surface, or the combined metal surface of two or more of these metal surfaces are shown.

EXAMPLES 11 to 17 and COMPARATIVE EXAMPLES 5 to 7

The procedure of EXAMPLE 1 was repeated except for using three kinds consisting of a cold rolled steel sheet (an iron-based metal surface), an alloyed melt zinc-plated steel sheet (a zinc-based metal surface) and an aluminum alloy sheet (based on Al-Mg alloy) (an aluminum-based metal surface) (a surface area ratio of these metal surfaces was 2:5:3) as a metal to be treated, using the zinc-phosphating solutions having composition shown in Table 5, and supplementing to the zinc-phosphating solutions a concentrated solution for supplement comprising an aqueous solution containing sodium nitrite in a concentration of 20% by weight in accordance with decrease of the $NO_2$ ion concentration as well as a concentrated solution for supplement of other components (with the proviso that a simple fluoride was excluded) in accordance with decrease of the acidity of a free acid. Thereby coated metal sheets were obtained. Management of the simple fluoride concentration in terms of HF was carried out by continuously measuring an active fluorine concentration using a silicon electrode meter (trade name: Surfproguard 101N, made by Nippon Paint Co., Ltd.) and by adding to the zinc-phosphating solutions a concentrated solution for supplement comprising an aqueous solution containing acidic sodium fluoride in a concentration of 2% by weight so as to maintain a measured value of the active fluorine concentration at an initial value.

TABLE 5

| composition of zinc phosphating solution | EXAMPLE | | | | | | | COMPARATIVE EXAMPLE | | |
|---|---|---|---|---|---|---|---|---|---|---|
| | 11 | 12 | 13 | 14 | 15 | 16 | 17 | 5 | 6 | 7 |
| Zn ion (g/l) | 1.0 | 1.0 | 1.0 | 1.0 | 1.0 | 1.0 | 1.0 | 1.0 | 1.0 | 1.0 |
| $PO_4$ ion (g/l) | 15.0 | 15.0 | 15.0 | 15.0 | 5.0 | 15.0 | 15.0 | 15.0 | 15.0 | 15.0 |
| $La(NO_3)_3$* (g/l) | 0.6 | 0.6 | 1.5 | 0.6 | 0.6 | 0.1 | 0.6 | — | — | — |
| Mn ion (g/l) | 1.0 | 0.6 | 0.6 | 0.6 | 0.6 | 0.6 | 0.6 | — | 0.6 | 0.6 |
| Co ion (g/l) | — | 0.6 | — | — | — | 0.6 | 0.5 | — | 0.6 | — |
| Mg ion (g/l) | — | — | 1.0 | — | — | 0.2 | — | — | 0.2 | — |
| Cu ion (g/l) | — | — | — | 0.01 | — | — | — | — | — | — |
| Ca ion (g/l) | — | — | — | — | 0.5 | 0.3 | — | — | 0.3 | — |
| Ni ion (g/l) | — | — | — | — | — | — | 0.2 | — | — | 1.0 |
| concentration in terms of HF (g/l) | 0.3 | 0.3 | 0.3 | 0.3 | 0.3 | 0.3 | 0.3 | 0.3 | — | 0.3 |
| $SiF_6$ ion (g/l) | 0.5 | 0.8 | 0.5 | 0.5 | 0.5 | 0.5 | 0.5 | 0.5 | — | 0.8 |
| $NO_2$ ion (g/l) | 0.14 | 0.14 | 0.14 | 0.14 | 0.14 | 0.14 | 0.14 | 0.09 | 0.09 | 0.09 |
| $NO_3$ ion (g/l) | 6.0 | 6.0 | 6.0 | 6.0 | 6.0 | 6.0 | 6.0 | 6.0 | 6.0 | 6.0 |
| total acidity (point) | 19.2 | 19.3 | 22.6 | 19.3 | 19.8 | 20.6 | 20.1 | 18.2 | 19.9 | 20.0 |
| acidity of free acid (point) | 0.7 | 0.7 | 0.7 | 0.7 | 0.7 | 0.7 | 0.7 | 0.7 | 0.7 | 0.7 |

*weight (g/l) in terms of lanthanum metal.

For the coated metal sheets obtained in EXAMPLES 11 to 17 and COMPARATIVE EXAMPLES 5 to 7, coating film qualities were examined and evaluated by carrying out the forementioned tests. Their results are shown in Table 6.

TABLE 6

| material | test item | EXAMPLE | | | | | | | COMPARATIVE EXAMPLE | | |
|---|---|---|---|---|---|---|---|---|---|---|---|
| | | 11 | 12 | 13 | 14 | 15 | 16 | 17 | 5 | 6 | 7 |
| cold rolled steel sheet | warm brine resistance (mm) | 1.0 | 0.3 | 0.5 | 1.0 | 1.0 | 1.0 | 0.3 | 8.0 | 1.0 | 1.0 |
| | water resistant secondary adhesion | 100 | 100 | 100 | 100 | 100 | 100 | 100 | 100 | 100 | 100 |
| | scab resistance (mm) | 8.0 | 6.0 | 7.0 | 5.0 | 8.0 | 7.0 | 6.0 | 15.0 | 11.0 | 9.0 |
| alloyed melt zinc-plated steel sheet | warm brine resistance (mm) | 2.5 | 2.0 | 2.5 | 2.5 | 2.5 | 2.0 | 2.0 | 10.0 | 3.5 | 2.5 |
| | water resistant secondary adhesion | 100 | 100 | 100 | 100 | 100 | 100 | 100 | 10 | 70 | 100 |
| | scab | 1.5 | 1.0 | 1.5 | 1.0 | 1.0 | 1.5 | 1.0 | 8.0 | 4.0 | 1.5 |

TABLE 6-continued

| material | test item | EXAMPLE 11 | 12 | 13 | 14 | 15 | 16 | 17 | COMPARATIVE EXAMPLE 5 | 6 | 7 |
|---|---|---|---|---|---|---|---|---|---|---|---|
| | resistance (mm) | | | | | | | | | | |
| aluminum alloy sheet | warm brine resistance (mm) | 3.0 | 1.5 | 2.0 | 1.5 | 1.5 | 2.5 | 2.0 | 7.0 | 7.0 | 3.0 |
| | water resistant secondary adhesion | 100 | 100 | 100 | 100 | 100 | 100 | 100 | 50 | 65 | 100 |
| | scab resistance (mm) | 2.5 | 1.0 | 1.5 | 2.0 | 1.5 | 1.5 | 0.6 | 10.0 | 4.5 | 3.0 |

As seen in Tables 5 and 6, in EXAMPLES 11 to 17, the warm brine resistance and scab resistance of all the iron-based metal surface, the zinc-based metal surface and the aluminum-based metal surface were elevated and, in addition, the water resistant secondary adhesion of both the zinc-based metal surface and the aluminum-based metal surface were elevated compared with those in COMPARATIVE EXAMPLE 5 in which a phosphating solution containing neither a nickel ion nor a lanthanum compound was used. In EXAMPLES 12 to 14, 16 and 17, the scab resistance of the iron-based metal surface as well as the warm brine resistance and scab resistance of the aluminum-based metal surface were elevated compared with those in COMPARATIVE EXAMPLE 7 in which a phosphating solution not containing a lanthanum compound but a nickel ion was used. In EXAMPLE 15, the warm brine resistance and scab resistance of the aluminum-based metal surface were elevated compared with those in COMPARATIVE EXAMPLE 7. Properties in EXAMPLE 11 were almost equal to those in COMPARATIVE EXAMPLE 7.

What is claimed are:

1. A method for zinc-phosphating a metal surface, comprising forming a zinc phosphate coating film on a metal surface by bringing the metal surface into contact with an acidic zinc-phosphating solution containing a zinc ion in a concentration of 0.1 to 2.0 g/l, a phosphate ion in a concentration of 5 to 40 g/l, a lanthanum compound in a concentration of 0.001 to 3 g/l in terms of a lanthanum metal, and a phosphating accelerator.

2. A method for zinc-phosphating a metal surface, comprising forming a zinc phosphate coating film on a metal surface by bringing at least one metal surface selected from an iron-based metal surface and a zinc-based metal surface into contact with an acidic zinc-phosphating solution which contains a zinc ion in a concentration of 0.1 to 2.0 g/l, a phosphate ion in a concentration of 5 to 40 g/l, a lanthanum compound in a concentration of 0.001 to 3 g/l in terms of a lanthanum metal, a manganese ion in a concentration of 0.1 to 3 g/l, and a phosphating accelerator and has a weight ratio of the zinc ion to the lanthanum metal in a range from 1:0.01 to 1:1.5.

3. A method for zinc-phosphating a metal surface as claimed in claim 1, wherein the acidic zinc-phosphating solution contains a fluorine compound in a concentration of 0.05 g/l or more.

4. A method for zinc-phosphating a metal surface as claimed in claim 2, wherein the acidic zinc-phosphating solution contains a fluorine compound in a concentration of 0.05 g/l or more.

5. A method for zinc-phosphating a metal surface, comprising forming a zinc phosphate coating film on a metal surface by bringing at least one metal surface selected from an iron-based metal surface, a zinc-based metal surface, or an aluminum-based metal surface into contact with an acidic zinc-phosphating solution which contains a zinc ion in a concentration of 0.1 to 2.0 g/l, a phosphate ion in a concentration of 5 to 40 g/l, a manganese ion in a concentration of 0.1 to 3 g/l, a simple fluoride compound in a concentration of 0.01 to 0.5 g/l in terms of a HF concentration, a complex fluoride ion in a concentration of 0.05 g/l or more, a lanthanum compound in a concentration of 0.001 to 3 g/l in terms of a lanthanum metal, and a phosphating accelerator and has a weight ratio of the zinc ion to the lanthanum metal in a range from 1:0.01 to 1:1.5.

6. A method for zinc-phosphating a metal surface as claimed in claim 1, wherein the acidic zinc-phosphating solution contains a metal ion selected from the group consisting a cobalt ion in a concentration of 0.1 to 4 g/l, a magnesium ion in a concentration of 0.01 to 3 g/l, a calcium ion in a concentration of 0.01 to 3 g/l, and a copper ion in a concentration of 0.005 to 0.2 g/l.

7. A method for zinc-phosphating a metal surface as claimed in claim 1, wherein the phosphating accelerator is selected from the group consisting a nitrite ion in a concentration of 0.01 to 0.5 g/l, a m-nitrobenzenesulfonate ion in a concentration of 0.05 to 5 g/l, and hydrogen peroxide in a concentration of 0.5 to 10 g/l.

8. A method for zinc-phosphating a metal surface as claimed in claim 6, wherein the phosphating accelerator is selected from the group consisting of a nitrite ion in a concentration of 0.01 to 0.5 g/l, a m-nitrobenzenesulfonate ion in a concentration of 0.05 to 5 g/l, and hydrogen peroxide in a concentration of 0.5 to 10 g/l.

* * * * *